US008468614B2

(12) United States Patent
Engdahl

(10) Patent No.: US 8,468,614 B2
(45) Date of Patent: Jun. 25, 2013

(54) FLUID CONTAINER CARRYING DEVICE AND A NECK PROTECTION DEVICE PROVIDED WITH SUCH A FLUID CONTAINER CARRYING DEVICE

(75) Inventor: Karl-Johan Engdahl, Skurup (SE)

(73) Assignee: USWE Sports AB (SE)

( * ) Notice: Subject to any disclaimer, the term of this patent is extended or adjusted under 35 U.S.C. 154(b) by 0 days.

(21) Appl. No.: 13/147,720

(22) PCT Filed: Feb. 4, 2009

(86) PCT No.: PCT/SE2009/050113

§ 371 (c)(1),
(2), (4) Date: Aug. 3, 2011

(87) PCT Pub. No.: WO2010/090559

PCT Pub. Date: Aug. 12, 2010

(65) Prior Publication Data

US 2011/0290830 A1 Dec. 1, 2011

(51) Int. Cl.
*A41D 13/00* (2006.01)

(52) U.S. Cl.
USPC ..... 2/468; 2/415; 224/148.2; 224/148.7

(58) Field of Classification Search
USPC ..... 2/410, 415, 468; 141/2, 18; 224/148.2, 224/148.7
See application file for complete search history.

(56) References Cited

U.S. PATENT DOCUMENTS

| | | | | |
|---|---|---|---|---|
| 5,722,573 | A * | 3/1998 | Carnel | 224/148.2 |
| 6,626,733 | B1 | 9/2003 | Knutson | |
| 7,201,299 | B2 * | 4/2007 | Forsman | 224/148.2 |
| 7,861,326 | B2 * | 1/2011 | Harty | 2/468 |
| 2006/0113336 | A1 | 6/2006 | Spencer | |

FOREIGN PATENT DOCUMENTS

| | | | |
|---|---|---|---|
| WO | 9901045 | A1 | 1/1999 |
| WO | 2004019713 | A1 | 3/2004 |
| WO | 2008130324 | A1 | 10/2008 |

OTHER PUBLICATIONS

International Search Report for PCT/SE2009/050113, Completed by the Swedish Patent Office on Sep. 30, 2009, 3 Pages.

* cited by examiner

*Primary Examiner* — Alissa Tompkins
(74) *Attorney, Agent, or Firm* — Brooks Kushman P.C.

(57) ABSTRACT

A fluid container carrying device including a back piece and a front piece forming a pocket having an opening for receiving and holding a fluid container, wherein the fluid container carrying device further including a first strap provided with a first fastener for fastening to a first side portion of a neck protection device, a second strap provided with a second fastener for fastening to a second side portion of the neck protection device, and a fastening means arranged on the back piece of the pocket for fastening to a rear lower member of the neck protection device. The present invention also relates to a neck protection device provided with such a fluid container carrying device.

9 Claims, 4 Drawing Sheets

Figure 1:
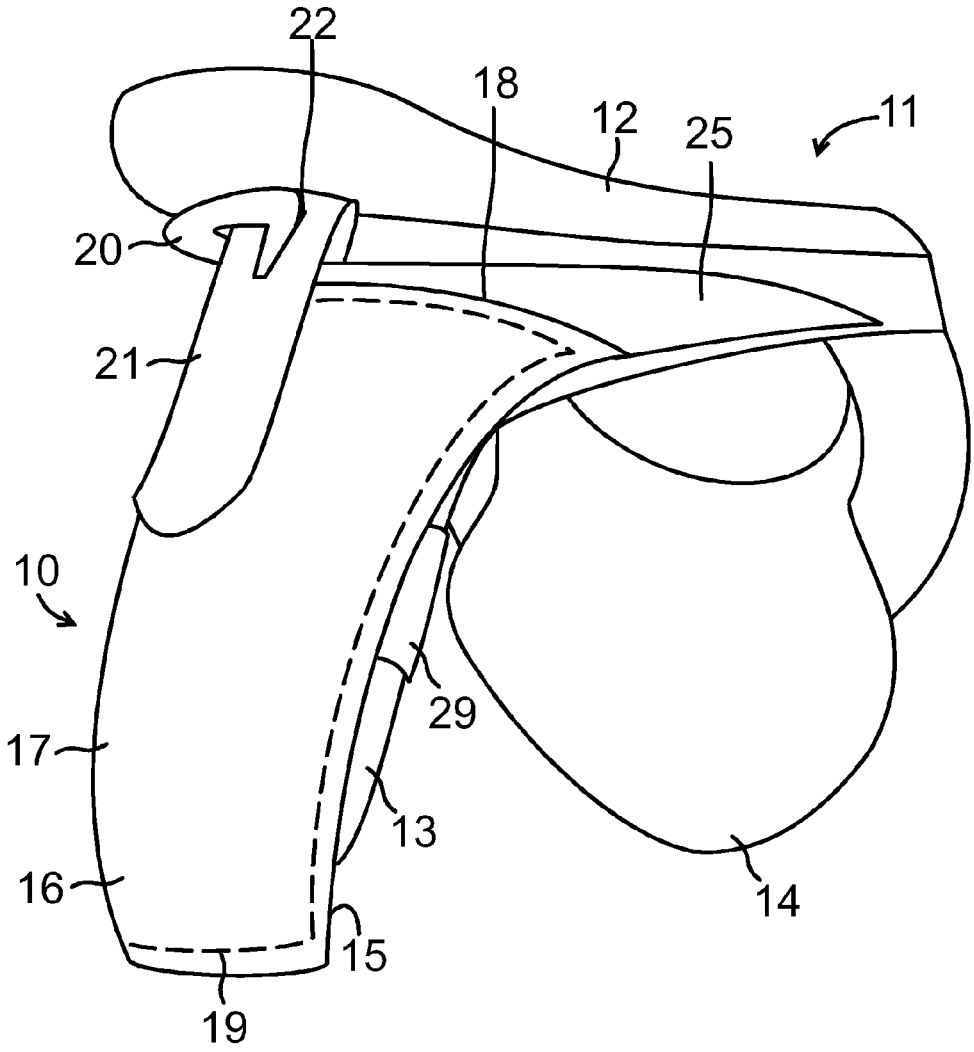

FLUID CONTAINER CARRYING DEVICE AND A NECK PROTECTION DEVICE PROVIDED WITH SUCH A FLUID CONTAINER CARRYING DEVICE

CROSS-REFERENCE TO RELATED APPLICATION

This application is the U.S. national phase of PCT Appln. No. PCT/SE2009/050113 filed Feb. 4, 2009, the disclosure of which is incorporated in its entirety by reference herein.

FIELD OF THE INVENTION

The present invention relates to a fluid container carrying device. Such fluid container carrying devices are commonly used for carrying a fluid container with water or a sports drink during a sports activity. The present invention also relates to a neck protection device provided with such a fluid container carrying device. Neck protection devices are used in connection with activities requiring the use of a helmet, such as within the field of motor sports. The need for fluid arises all the time and the fluid container carrying device according to the invention is designed for receiving and holding a fluid container, so that active and needing people easily can carry a fluid container and be replenished with fluid.

PRIOR ART

There are several different types of fluid container carrying devices and systems in the prior art. The most common is backpacks with accompanying fluid containers. These fluid containers are generally made of silicone and are reusable. The fluid is sucked up from the container through a flexible tube and a non return valve to the mouthpiece.

WO2008/130324 discloses a mobile hydration system comprising a shirt/top having a back pocket designed to hold a fluid container in place during use. The pocket arranged in the shirt/top is adapted to prevent the fluid container from displacement. Generally, this is provided by the design of the pocket and by means of the elastic material in the shirt/top and the pocket.

WO99/01045 discloses a sport shirt having an integrated water bag with a flexible tube extending from the water bag towards a user. The flexible tube is preferably provided with a bite nozzle for controlling the water flow. The shirt and the pocket are designed to prevent the fluid container from being displaced which is achieved by means of the design of the pocket and by means of the elastic material in the shirt and the pocket.

SUMMARY OF THE INVENTION

One object of the present invention is to provide a fluid container carrying device which is easy to use by a person during a motor sports activity or any other activity in which a helmet is used.

The present invention relates to a fluid container carrying device comprising a back piece and a front piece forming a pocket having an opening for receiving and holding a fluid container, characterised in that the fluid container carrying device further comprises a first strap and a second strap projecting from the pocket, wherein the first strap is provided with a first fastener for fastening to a first side portion of a neck protection device, the second strap is provided with a second fastener for fastening to a second side portion of the neck protection device, and a fastening means is arranged on the back piece of the pocket for fastening to a rear lower member of the neck protection device. Hence, the fluid container carrying device according to the invention can easily be fastened to a neck protection device, so that a person safely and comfortably can wear the fluid container carrying device and bring a fluid container for fluid replenishment during a motor sports activity.

The neck protection device is, for example, a motor sports neck protection device for a person wearing a helmet, which helps to bring the head of a person to a controlled stop, if necessary, to prevent injury. The neck protection device can comprise a rear lower member for engaging the back of a person, a front lower member for engaging the upper front chest of a person and a neck enclosing portion having side portions, so that extensive movement of a persons head can be prevented due to that the helmet movement is stopped by the neck enclosing portion and a force applied thereon is transferred to the body of the person through the front and rear lower members. The neck protection device is thus designed to help prevent extensive forward head movement, extensive rearward head movement, extensive sideways head movement and compression of the spinal column due to the effect of force on the helmet. The neck protection device can be designed as a neck brace system such as the Leatt-Brace™ or similar. The neck protection device can be an injection moulded article of for example glass reinforced nylon or carbon fibre or similar materials forming a padded rigid structure acting as an alternate load path for forces applied to the neck. The side portions of the neck protection device can comprise hook and loop fasteners on the outer side, which hook and loop fasteners normally is used for fastening a padding or similar. Said hook and loop fasteners of the side portions can be used for fastening the fasteners of the straps of the fluid container carrying device according to the invention.

The fastening means of the fluid container carrying device can be formed as a loop for enclosing the rear lower member of the neck protection device, wherein the rear lower member is passed through the loop when the fluid container carrying device is mounted on the neck protection device. Alternatively, the fastening means can be arranged as a hook and loop fastener for fastening to the back of the rear lower member of the neck protection device. Hence, the fastening means in combination with the straps with the fasteners result in a safe fastening of the fluid container carrying device. The fasteners of the straps can be hook and loop fasteners for fastening to the side portions of the neck enclosing portion of the neck protection device. This results in a quick and easy fastening, wherein corresponding hook and loop fasteners of a padding of the neck protection device can be used to fasten the fluid container carrying device.

A fluid container can be arranged in the pocket and a flexible drink tube having a mouthpiece with a valve can be connected to the fluid container, so that a person can grip the mouthpiece, put it into the mouth and be replenished with fluid when opening the valve and then put the mouthpiece back into a storing position or simply let it go. A fluid in the fluid container, such as water, a sports drink or similar, can be pressurized, for example by means of a pump or manually by blowing air into the fluid container through the mouthpiece. If the fluid is pressurized it is pushed out through the drink tube when the valve of the mouthpiece is opened, so that a person can be replenished with a minimum of effort.

The fasteners can be hook and loop fasteners, such as Velcro™. For example, the fasteners are arranged as elongated strips of hook and loop fasteners arranged along the straps, respectively, for detachable fastening. Of course other types of fasteners can also be used, such as buttons, strings, etc.

Further characteristics and advantages of the present invention will become apparent from the description of the embodiments below, the appended drawings and the dependent claims.

SHORT DESCRIPTION OF THE DRAWINGS

Figure 2:
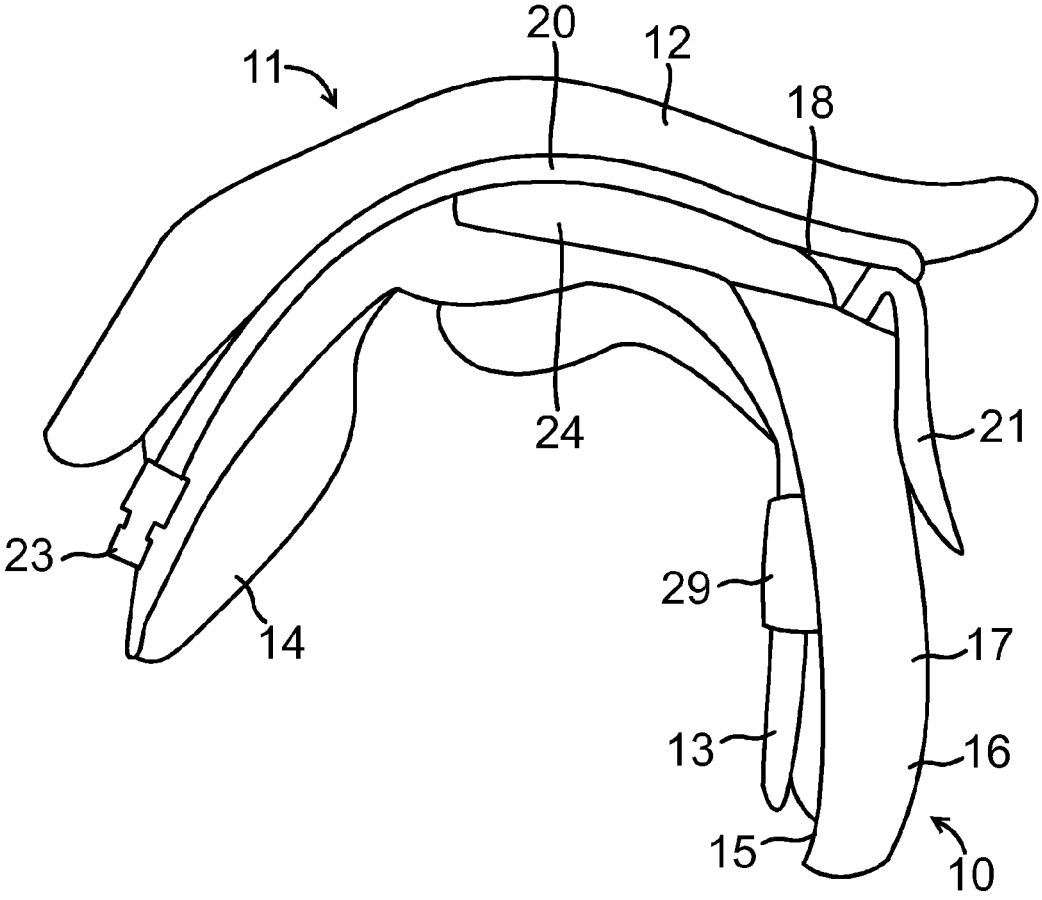
Figure 3:
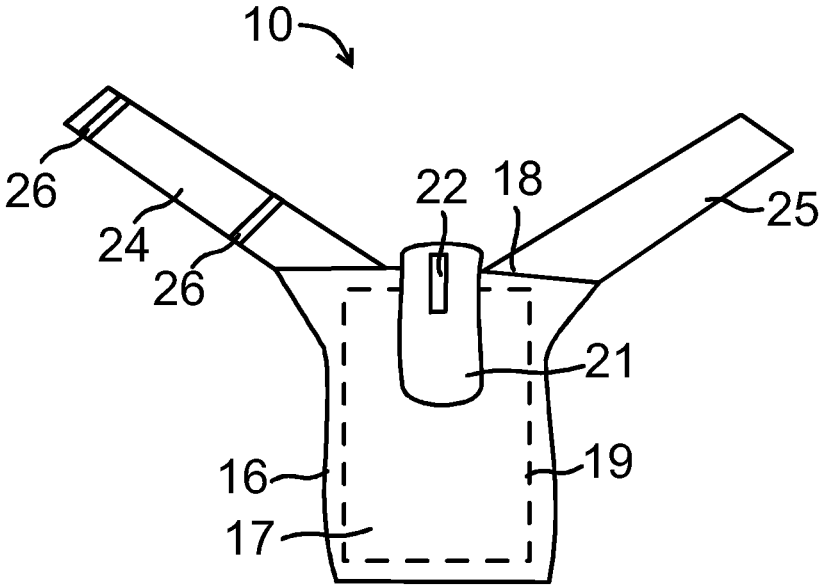
Figure 4:
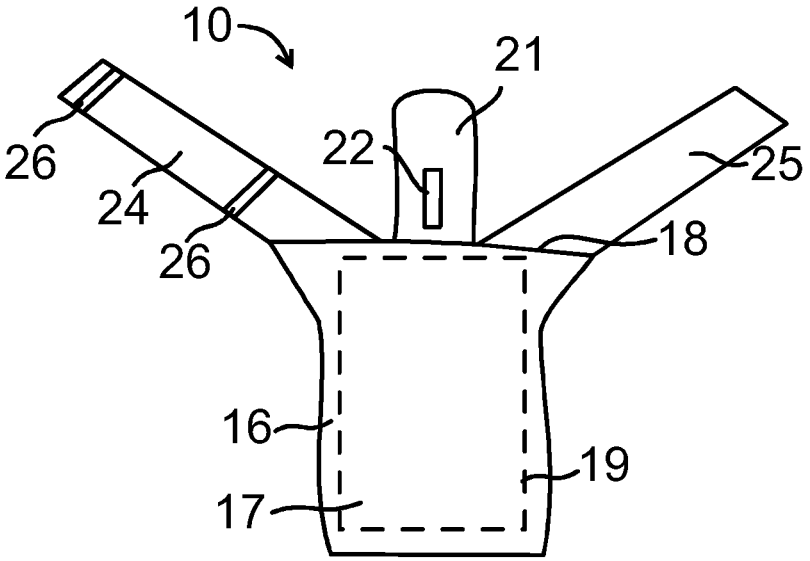
Figure 5:
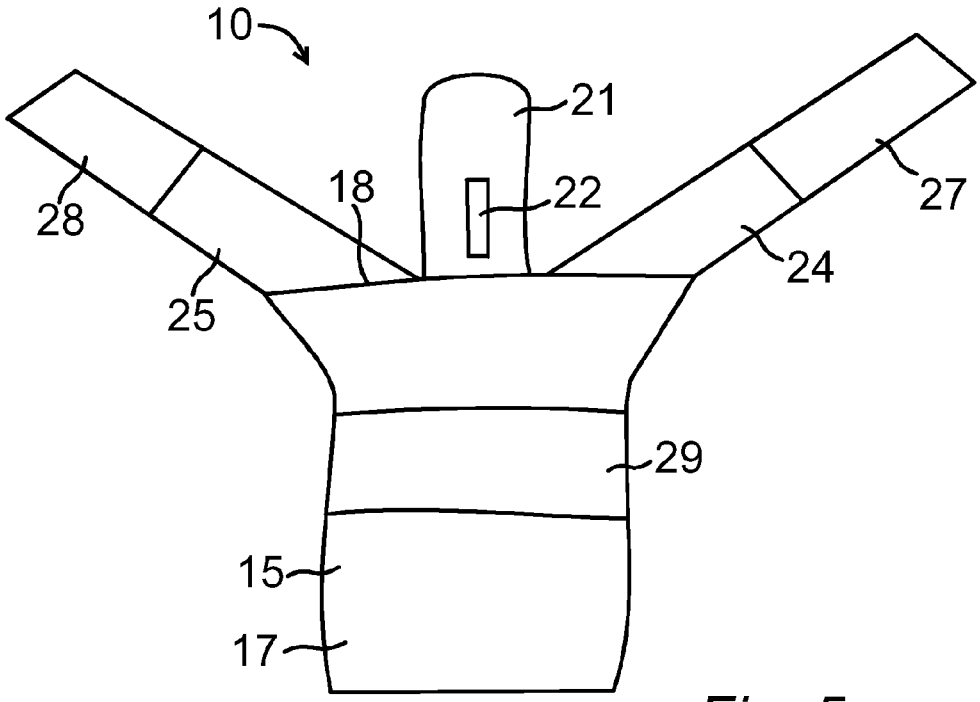
Figure 6:
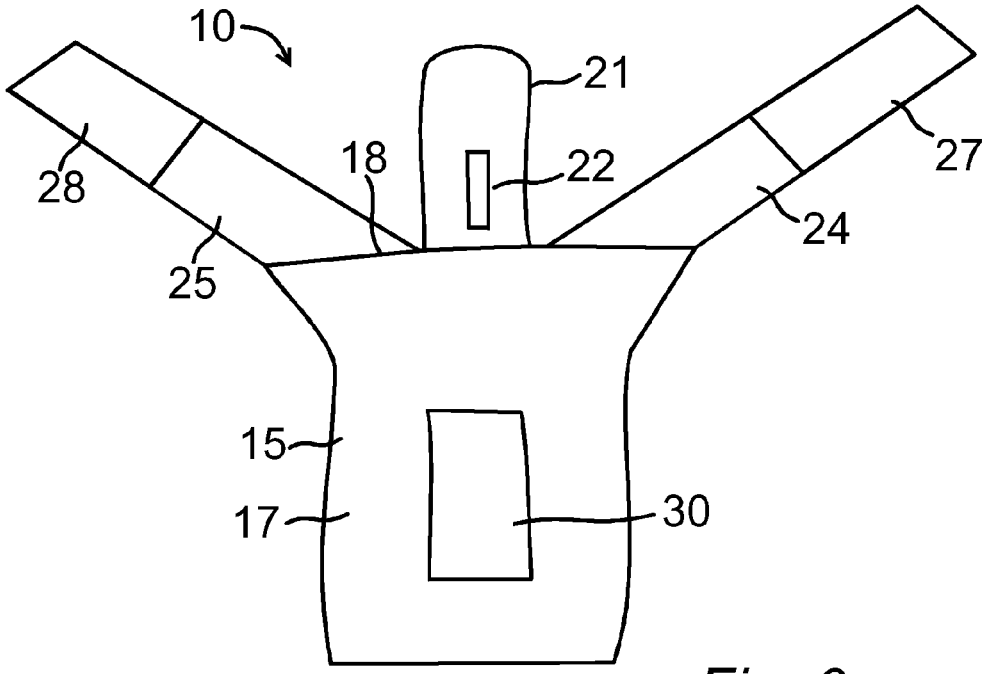

The invention will now be described more in detail with the aid of embodiments and with reference to the appended drawings, in which FIG. 1 is a schematic perspective view of a fluid container carrying device according to one embodiment of the invention, wherein the fluid container carrying device is fastened to a neck protection device and is provided with a drink tube connected to a fluid container arranged inside the fluid container carrying device, FIG. 2 is a schematic side view of the fluid container carrying device according to FIG. 1, FIG. 3 is a schematic front view of a fluid container carrying device according to one embodiment of the invention, showing a fluid container by means of dashed lines and a flap in a closed position, FIG. 4 is a schematic front view of the fluid container carrying device according to FIG. 3, showing the fluid container by means of dashed lines and a flap in an open position, FIG. 5 is a schematic back view of the fluid container carrying device according to one embodiment of the invention, and FIG. 6 is a schematic back view of the fluid container carrying device according to one alternative embodiment of the invention.

DETAILED DESCRIPTION OF THE INVENTION

In FIGS. 1 and 2 a fluid container carrying device 10 according to one embodiment of the invention is illustrated, wherein the fluid container carrying device 10 is fastened to a neck protection device 11. The neck protection device 11 is arranged to enclose the neck of a person wearing a helmet and to prevent injury due to excessive head movement as a result of an accident. The neck protection device 11 comprises a neck enclosing portion 12, through which a person can pass his head, for wearing the neck protection device 11. The neck protection device 11 further comprises a rear lower member 13 for engaging the back of a person, so that any forces received on the neck enclosing portion 12 from a moving helmet can be directed to the rear lower member 13 and distributed to the back of the person wearing the neck protection device 11. The neck protection device 11 further comprises a front lower member 14 for engaging the chest of a person, so that any forces received on the neck enclosing portion 12 from a moving helmet can be directed to the front lower member 14 and distributed to the chest of the person wearing the neck protection device 11.

The fluid container carrying device 10 is, for example, made of flexible fabric or similar. The fluid container carrying device 10 comprises a back piece 15 and a front piece 16 forming a pocket 17 having an opening 18 for receiving and holding a fluid container 19, which fluid container 19 is illustrated by means of dashed lines. The fluid container 19 is arranged for containing a fluid, such as water, sports drink or similar, and is connected to a flexible drink tube 20, so that a person can be replenished with fluid from the fluid container 19 through the drink tube 20.

The pocket 17 is provided with a flap 21 for closing the opening 18 of the pocket 17. For example, the opening 18 of the pocket 17 is an upper opening, so that the fluid container 19 can be inserted into the pocket 17 from above. The flap 21 is connected to the back piece 15 and is detachably fastened to the front piece 16 of the pocket 17. For example, the flap 21 is arranged centrally in the lateral direction over the opening 18 of the pocket 17. The flap 21 is provided with a through aperture 22 for the drink tube 20, so that the drink tube 20 runs through the aperture 22. For example, the drink tube 20 is fixed to the fluid container 19, wherein the fluid container 19 is arranged in a fixed position in the pocket 17 by means of the drink tube 20 running through the aperture 22 in the pocket flap 21.

The flexible drink tube 20 is provided with a mouthpiece 23, which is illustrated in FIG. 2, and is connected to the fluid container 19 so that a person can engage the mouthpiece 23 to obtain fluid from the fluid container 19. For example, the fluid container 19 is formed in a plastic material, such as polyethylene or similar. The flexible drink tube 20 is for example formed in a plastic material, such as polyethylene or polyvinylchloride or similar. For example, the flexible drink tube 20 is formed in polyethylene, wherein the fluid container 19 is formed in another plastic material than polyethylene. For example, the fluid container 19 is disposable to avoid risks and problems with bacteria and contamination. The plastic material used is for example recyclable and emits only water and carbon dioxide upon combustion. According to one embodiment, the fluid container 19 is arranged with a plurality of compartments for stabilizing the fluid container. The fluid container 19 is for example formed as a bag of two joined films of airtight or gasproof material. The drink tube 20, for example, extends through a leak-proof tube outlet arranged centrally in the container to a position in which one end is arranged close to the bottom of the container. The seal between the drink tube 20 and the container 19 around the flexible tube outlet prevents fluid leakage and makes it possible to maintain a considerable positive pressure in the container 19. Further, the two films are for example connected directly to each other in elongated wall portions forming said compartments. The drink tube 20 projects from the container 19 and is provided with the mouthpiece 23, the mouthpiece 23 being provided with a valve. The valve makes it possible to blow in air to provide positive pressure in the container 19. The valve is also used to open up for a fluid flow when the user wants to drink.

The fluid container carrying device 10 is arranged to be detachably connected to the neck protection device 11, so that a person wearing the neck protection device 11 easily and comfortably can bring a fluid container 19 with fluid during for example a motor sports activity. With reference particularly to FIGS. 3-6 the fluid container carrying device 10 is illustrated according to two different embodiments. The fluid container carrying device 10 comprises a first strap 24 and a second strap 25 projecting from the pocket 17. For example, the straps 24, 25 extend from an upper portion of the pocket 17, i.e. from a position close to the opening 18 of the pocket 17. For example, the straps 24, 25 extend upward and outward from the back piece 15, wherein the fluid container carrying device 10 is Y-shaped when disengaged from the neck protection device 11 and spread out on a level surface. For example, the first strap 24 is provided with loops 26 through which the drink tube 20 can run for holding the drink tube 20 in position. FIG. 3 shows the flap 21 in a closed position, in which the fluid container 19 is fixed in the pocket 17, and FIG. 4 shows the flap 21 in an open position, in which the fluid container 19 can be put in or brought out from the pocket 17.

With reference to FIGS. 5 and 6 the first strap 24 is provided with a first fastener 27 for fastening to a first side portion of the neck protection device 11, wherein the second strap 25 is provided with a second fastener 28 for fastening to a second side portion of the neck protection device 11. For example, the first and second fasteners 27, 28 comprise hook and loop fasteners, such as Velcro™. Alternatively, the fasteners 27, 28 comprise buttons, strings or similar means for detachably connecting the fluid container carrying device 10 to the neck protection device 11.

The back piece 15 of the pocket 17 is provided with a fastening means 29, 30 for fastening to the rear lower member 13 of the neck protection device 11. According to the embodiment of FIG. 5, the fastening means is formed as a loop 29. According to the embodiment of FIG. 6, the fastening means is formed as hook and loop fastener 30, such as Velcro™.

With reference back to FIGS. 1 and 2 it is illustrated that the straps 24, 25 are arranged for extending along a portion of the neck enclosing portion 12 of the neck protection device 11, towards the front thereof, so that the fasteners 27, 28 can be connected to the side portions of the neck enclosing portion 12. Further the fastening means in the form of the loop 29 is arranged to be passed over and enclose the rear lower member 13 for fastening the fluid container carrying device 10 to the neck protection device 11. Alternatively, the fastening means in the form of a hook and loop fastener 30 is arranged to cooperate with a hook and loop fastener attached to the rear lower member 13. Hence, the fluid container carrying device 10 is arranged for enclosing the rear portion of the neck protection device 11. According to one embodiment of the invention, the fasteners 27, 28 are arranged to cooperate with a padding holding hook and loop fastener of the neck enclosing portion 12 of the neck protection device 11.

According FIG. 2 the drink tube 20 extends from the fluid container 19 and runs along the first strap 24 and the side portion of the neck enclosing portion 12 and is terminated with the mouthpiece 23 with the valve at the front lower member 14. As described above with reference to FIGS. 3 and 4 the first strap 24 can be provided with loops 26 through which the drink tube 20 can run for holding the drink tube 20 in position. Hence, a person can retrieve the drink tube 20 and the mouthpiece 23 from its storing position at the front lower member 14 and put the mouthpiece 23 to the mouth for fluid replenishment and then put it back in its storing position again while performing a motor sports activity.

For example, the pocket 17 is formed in an elastic material and will be somewhat extended when a filled fluid container 19 is inserted therein. Hence, the pocket 17 will be extended, particularly in the lateral direction, and the fluid container 19 will be put under pressure. This pressure results in that the fluid in the fluid container 19 is exposed to an increased pressure. The increased pressure facilitates further when the user opens up the valve in the mouthpiece 23 and fluid is pushed out through the drink tube 20.

Fluid containers 19 according to the invention are suitably made of joined films of thin plastic material, which is approved for use with foodstuff. One suitable plastic material is ethylene plastic. Further, the material should be somewhat stretchable and relatively impermeable to gas or air, so that a positive pressure can be maintained during a normal period of use. The films are joined, for example by welding or heating, in a joint being circumferential except for the drink tube outlet.

The invention claimed is:

1. A fluid container carrying device for attachment to a neck protection device for a person wearing a helmet comprising:

a back piece and a front piece forming a pocket there between having an opening for receiving and holding a fluid container, a first strap provided with a first fastener for fastening to the first side portion of a neck protection device, the neck protection device having a rear lower member adapted to engage the back of the person, a front lower member adapted to engage the upper front chest of a person and a neck enclosing portion for encircling a neck of the person and having a first and second side portion, the neck enclosing portion being arranged to prevent extensive movement of the head of the person by stopping helmet movement and to transfer a force applied to the neck enclosing portion to a body of the person through the front and rear lower members;

a second strap provided with a second fastener for fastening to the second side portion of the neck protection device, and a fastening means arranged on the back piece of the pocket for fastening to the rear lower member of the neck protection device, wherein the fastening means comprises a loop for enclosing the rear lower member of the neck protection device.

2. A fluid container carrying device according to claim 1, wherein the first fastener and the second fastener are hook and loop fasteners for fastening to the side portions of the neck protection device.

3. A fluid container carrying device according to claim 1, wherein the pocket is provided with a flap having a through aperture for a flexible drink tube.

4. A fluid container carrying device according to claim 1, wherein the first strap is provided with drink tube holding loops for holding a drink tube in position.

5. A fluid container carrying device according to claim 1, wherein the first and second straps extend from an upper portion of the pocket when the device is connected to the neck protection device and are arranged with free end portions when disengaged from the neck protection device.

6. A fluid container carrying device according to claim 1, wherein a fluid container is arranged in the pocket and a flexible drink tube having a mouthpiece with a valve is connected to the fluid container.

7. A fluid container carrying device according to claim 6, further comprising a pressurizing means for pressurizing a fluid in the fluid container so that the fluid is pushed out through the drink tube when the valve of the mouthpiece is opened.

8. A Neck protection device for a person wearing a helmet, comprising:

a rear lower member configured for engaging the back of the person, a front lower member configured for engaging the upper front chest of a person and a neck enclosing portion configured for enclosing a neck of the person and having a first and second side portion, the neck enclosing portion being arranged to prevent extensive movement of the head of the person by stopping helmet movement and to transfer a force applied to the neck enclosing portion to a body of the person through the front and rear lower members, wherein the neck protection device is provided with a fluid container carrying device comprising:

a back piece and a front piece forming a pocket there between having an opening for receiving and holding a fluid container, a first strap provided with a first fastener for fastening to a first side portion of a the neck protection device, a second strap provided with a second fastener for fastening to a second side portion of the neck protection device, and a fastening means arranged on the back piece of the pocket for fastening to a rear lower member of the neck protection device, wherein the fastening means comprises a loop for enclosing the rear lower member of the neck protection device;

wherein the first fastener of the first strap of the fluid container carrying device being fastened to the first side portion of the neck protection device, the second fastener of the second strap of the fluid container carrying device being fastened to the second side portion of the neck protection device and the third strap being arranged to enclose the rear lower member of the neck protection device.

9. A fluid container carrying device comprising:

a back piece and a front piece forming a pocket there between having an opening for receiving and holding a fluid container;

a strap provided with a fastener for fastening to a portion of a neck protection device for attachment to a neck protection device for a person wearing a helmet, the neck protection device having a rear lower member adapted to engage the back of the person, a front lower member adapted to engage the upper front chest of a person and a neck enclosing portion for encircling a neck of the person and having a first and second side portion, the neck enclosing portion being arranged to prevent extensive movement of the head of the person by stopping helmet movement and to transfer a force applied to the neck enclosing portion to a body of the person through the front and rear lower members; and a fastening means arranged on the back piece of the pocket for fastening to a rear lower member of the neck protection device, wherein the fastening means comprises a strap arranged to form a loop for enclosing the rear lower member of the neck protection device.

* * * * *